US010527047B2

(12) United States Patent
Kamps et al.

(10) Patent No.: US 10,527,047 B2
(45) Date of Patent: Jan. 7, 2020

(54) ACTIVE STALL PREVENTION IN CENTRIFUGAL FANS

(71) Applicant: Energy Labs, Inc., San Diego, CA (US)

(72) Inventors: Frederick Q. Kamps, San Diego, CA (US); Andrew Frink, San Diego, CA (US)

( * ) Notice: Subject to any disclaimer, the term of this patent is extended or adjusted under 35 U.S.C. 154(b) by 188 days.

(21) Appl. No.: 15/850,589

(22) Filed: Dec. 21, 2017

(65) Prior Publication Data

US 2018/0209431 A1 Jul. 26, 2018

Related U.S. Application Data

(60) Provisional application No. 62/450,461, filed on Jan. 25, 2017.

(51) Int. Cl.

| | |
|---|---|
| ***F04D 27/00*** | (2006.01) |
| ***F04D 29/28*** | (2006.01) |
| ***F04D 17/16*** | (2006.01) |

(52) U.S. Cl.

CPC ..... *F04D 27/001* (2013.01); *F04D 17/16* (2013.01); *F04D 27/002* (2013.01); *F04D 27/004* (2013.01); *F04D 27/008* (2013.01); *F04D 29/281* (2013.01); *F04D 29/287* (2013.01); *F05B 2200/13* (2013.01); *F05B 2200/14* (2013.01); *F05B 2200/221* (2013.01); *F05B 2270/1081* (2013.01); *F05B 2270/3015* (2013.01)

(58) Field of Classification Search

CPC ..... F04D 27/001; F04D 17/16; F04D 27/002; F04D 27/004; F04D 27/008; F04D 29/281; F04D 29/287; F04D 15/0005; F04D 15/0022; F04D 15/005; F05B 2200/13; F05B 2200/14; F05B 2200/221; F05B 2270/1081; F05B 2270/3015

USPC ..... 415/14

See application file for complete search history.

(56) References Cited

U.S. PATENT DOCUMENTS

| | | | | |
|---|---|---|---|---|
| 1,930,794 A | | 7/1928 | Freeman | |
| 2,140,148 A | | 10/1936 | Whitmore | |
| 2,153,576 A | | 10/1936 | Kruth et al. | |
| 2,367,104 A | | 2/1943 | Demuth | |
| 3,042,291 A | * | 7/1962 | Greenwald | F04D 29/464 415/26 |

(Continued)

FOREIGN PATENT DOCUMENTS

| | | | | |
|---|---|---|---|---|
| EP | 2423449 A1 | * | 2/2012 | F01D 17/165 |
| EP | 2981699 B1 | * | 5/2017 | F04D 29/464 |

(Continued)

*Primary Examiner* — Justin D Seabe
*Assistant Examiner* — Brian Christopher Delrue
(74) *Attorney, Agent, or Firm* — Rod D. Baker; Dennis F. Armijo

(57) ABSTRACT

A system, method, and computer program to adjust the effective width of centrifugal fan wheel(s) in a fan system during operation. The reason for the adjustment is to prevent stall when running the fan over a wider range of system operating points. This is of particular use in high turndown variable air volume systems commonly encountered in HVAC systems. An additional option function is to isolate a single fan, in a fan system, if that fan should fail, to prevent reverse flow through the failed fan.

22 Claims, 11 Drawing Sheets

(56) References Cited

U.S. PATENT DOCUMENTS 3,473,727 A * 10/1969 Eastman ..... F04D 27/0223 415/27
3,972,644 A * 8/1976 Johnson ..... F01D 17/165 415/163
4,135,854 A 1/1979 Binstock et al.
4,662,817 A * 5/1987 Clark ..... F04D 27/023 415/1
4,684,319 A * 8/1987 Sasaki ..... F01D 17/165 415/164
4,726,744 A * 2/1988 Arnold ..... F01D 17/165 415/164
4,800,804 A 1/1989 Symington
4,806,833 A * 2/1989 Young ..... G05D 7/0676 318/400.08
4,850,267 A 7/1989 Peterson
4,859,140 A * 8/1989 Passadore ..... F04D 29/464 415/48
4,967,550 A * 11/1990 Acton ..... F01D 25/06 415/119
5,340,271 A * 8/1994 Freeman ..... F04D 27/0215 415/1
5,454,225 A * 10/1995 Sumser ..... F01D 9/045 415/166
5,683,223 A * 11/1997 Harada ..... F04D 27/02 415/17
5,873,696 A * 2/1999 Harada ..... F04D 27/0246 415/148
6,098,010 A * 8/2000 Krener ..... F04D 27/001 105/64.1
6,227,961 B1 * 5/2001 Moore ..... F04D 27/004 454/229
6,715,288 B1 * 4/2004 Engels ..... F01D 17/143 415/158
6,719,625 B2 * 4/2004 Federspiel ..... B61D 27/00 454/256
7,083,379 B2 * 8/2006 Nikpour ..... F04D 27/0246 415/144
7,117,827 B1 * 10/2006 Hinderks ..... F02B 75/00 123/43 R
7,800,262 B1 9/2010 Larson
8,021,218 B2 9/2011 Osvatic et al.
8,190,273 B1 * 5/2012 Federspiel ..... F24F 11/30 700/17
8,326,464 B2 * 12/2012 Clanin ..... F24F 11/0001 700/276
8,483,883 B1 * 7/2013 Watson ..... F24F 3/044 700/278
8,850,813 B2 * 10/2014 Lotterman ..... F01D 25/24 123/562
8,961,149 B2 2/2015 Mussalo et al.
9,683,484 B2 * 6/2017 Tingaud ..... F02B 37/24
10,371,158 B2 * 8/2019 Sorokes ..... F04D 27/001
2003/0026694 A1 * 2/2003 Groskreutz ..... F01D 17/165 415/164
2003/0064676 A1 * 4/2003 Federspiel ..... B61D 27/00 454/75
2004/0159103 A1 * 8/2004 Kurtz ..... F01D 17/08 60/772
2005/0091978 A1 * 5/2005 Sumser ..... F01D 17/16 60/608
2008/0267765 A1 * 10/2008 Chen ..... F04D 27/0207 415/58.4
2009/0104024 A1 * 4/2009 Kay ..... F01D 5/147 415/161
2009/0290977 A1 * 11/2009 Dilovski ..... F01D 5/046 415/146
2010/0196145 A1 * 8/2010 Lombard ..... F01D 17/14 415/148
2010/0311318 A1 * 12/2010 Hause ..... F04D 27/004 454/256
2011/0116911 A1 * 5/2011 Garrett ..... F01D 17/143 415/157
2012/0014777 A1 * 1/2012 Mussalo ..... F04D 27/009 415/1
2012/0186247 A1 * 7/2012 Marques ..... F01D 9/026 60/605.1
2013/0288589 A1 * 10/2013 Hu ..... F04D 27/004 454/256
2013/0288590 A1 * 10/2013 Hu ..... F24F 11/0001 454/256
2014/0093364 A1 * 4/2014 Narehood ..... F01D 9/026 415/191
2014/0308110 A1 * 10/2014 Houst ..... F02B 37/22 415/1
2016/0131145 A1 * 5/2016 Mohtar ..... F01D 17/141 417/380
2016/0177956 A1 * 6/2016 Mohtar ..... F01D 17/146 417/406
2016/0195109 A1 * 7/2016 Richards ..... F04D 29/266 60/602
2017/0030363 A1 * 2/2017 Hustvedt ..... F04D 25/14
2017/0074275 A1 * 3/2017 Thornton ..... F25B 1/053
2018/0209433 A1 * 7/2018 Sun ..... F04D 25/06

FOREIGN PATENT DOCUMENTS

GB 171787 A * 11/1921 ..... F04D 27/004
GB 1159314 A * 7/1969 ..... F02K 1/08
WO WO-2004048755 A1 * 6/2004 ..... F01D 17/167

* cited by examiner

ACTIVE STALL PREVENTION IN CENTRIFUGAL FANS

CROSS REFERENCE TO RELATED APPLICATIONS

This application claims the benefit of U.S. Provisional Patent Application No. 62/450,461, filed Jan. 25, 2017, entitled "Active Stall Prevention in Centrifugal Fans," the specification of which is incorporated herein by reference.

BACKGROUND OF THE INVENTION

Field of the Invention (Technical Field)

The claimed invention relates to centrifugal fan design and control, and more particularly to a system, method, and computer program to a control system for a backward inclined centrifugal fan assembly to allow for a wider range of operation of the fan system by controlling the effective width of the fan wheel.

Background Art

Backward inclined centrifugal fans are typically selected for maximum static efficiency when operating at design conditions. This results in the lowest power requirement, as the fan is operating near the stall region. However, if the fan system needs to operate a reduced flow rate, like those found in variable air volume distribution systems in office buildings, university buildings, etc., then, the fan is prone to stalling at a relatively high percentage of the design volume (cubic feet per minute (CFM)).

There are adverse effects to operating a backward inclined centrifugal fan system in the stall region such as excessive vibration in the fan and attached systems, and in extreme cases, mechanical failure of the fan assembly.

To overcome this limitation when selecting a fan system, it may be necessary to select a fan with a lower than desired peak static efficiency to allow for the required reduction in flow rate. This results in a higher peak power requirement for the fan system than would otherwise be possible. To select a fan with a lower peak static pressure, some possible methods are to select larger diameter fans at a slower speed, or to reduce the width of the fan wheel. Some issues with these approaches are that larger fans may not fit in the required space and are more expensive, and reducing the width of the fan wheel causes reduction in the peak efficiency of the fan.

An alternate method for reducing the air flow is to design a fan system consisting of multiple individual fan assemblies in parallel to allow for shutting down individual fans when low flow rates are required. This means using many smaller fans to allow for the large volume turndowns required of large fan systems. Smaller fans are generally less efficient than larger fans of the same design, so this again results in increased power consumption when running at design conditions. This method also limits the ability to provide a smooth delivery of air when the fans are cycled on and off.

An ideal solution to this problem is prevention of fan stall when operating at low volume deliveries and elevated static pressures, while maintaining a high efficiency system. The presently claimed invention allows for easy field tuning, positive shutoff, and monitoring of valve position during operation.

SUMMARY OF THE INVENTION (DISCLOSURE OF THE INVENTION)

The presently claimed invention solves the ongoing problems addressed above by providing a system, method, and computer program for adjusting the width of the wheel of a centrifugal fan and a control system to determine when to adjust the width of the wheel. The device for adjusting the width of the fan wheel consists of a conical valve that is allowed to move within the fan wheel on a linear guide. The valve is moved by a linear operator under direction of a controls system. Historically a valve of this type has been used on a fixed speed fan to adjust the volume of air being delivered. However, in the presently claimed invention, this device is used on a variable speed fan when volume delivery is controlled by adjusting the speed of the fan and the valve is being used to tune the effective width of the wheel to allow for efficient operation and to prevent stalling of the fan over a wide range of operating conditions.

The control system consists of a microprocessor based controller that monitors the flow rate of each fan in a fan system, and the total static pressure at which the fan is operating. Based on the performance data for the fan the controller is able to determine if the fan is too close to stall and adjust the position of the valve.

BRIEF DESCRIPTION OF THE DRAWINGS

The accompanying drawings, which are incorporated into and form a part of the specification, illustrate several embodiments of the presently claimed invention and, together with the description, explain the principles of the presently claimed invention. The drawings are only for illustrating a preferred embodiment of the presently claimed invention and are not to be construed as limiting the presently claimed invention. In the drawings:

Figure 1:
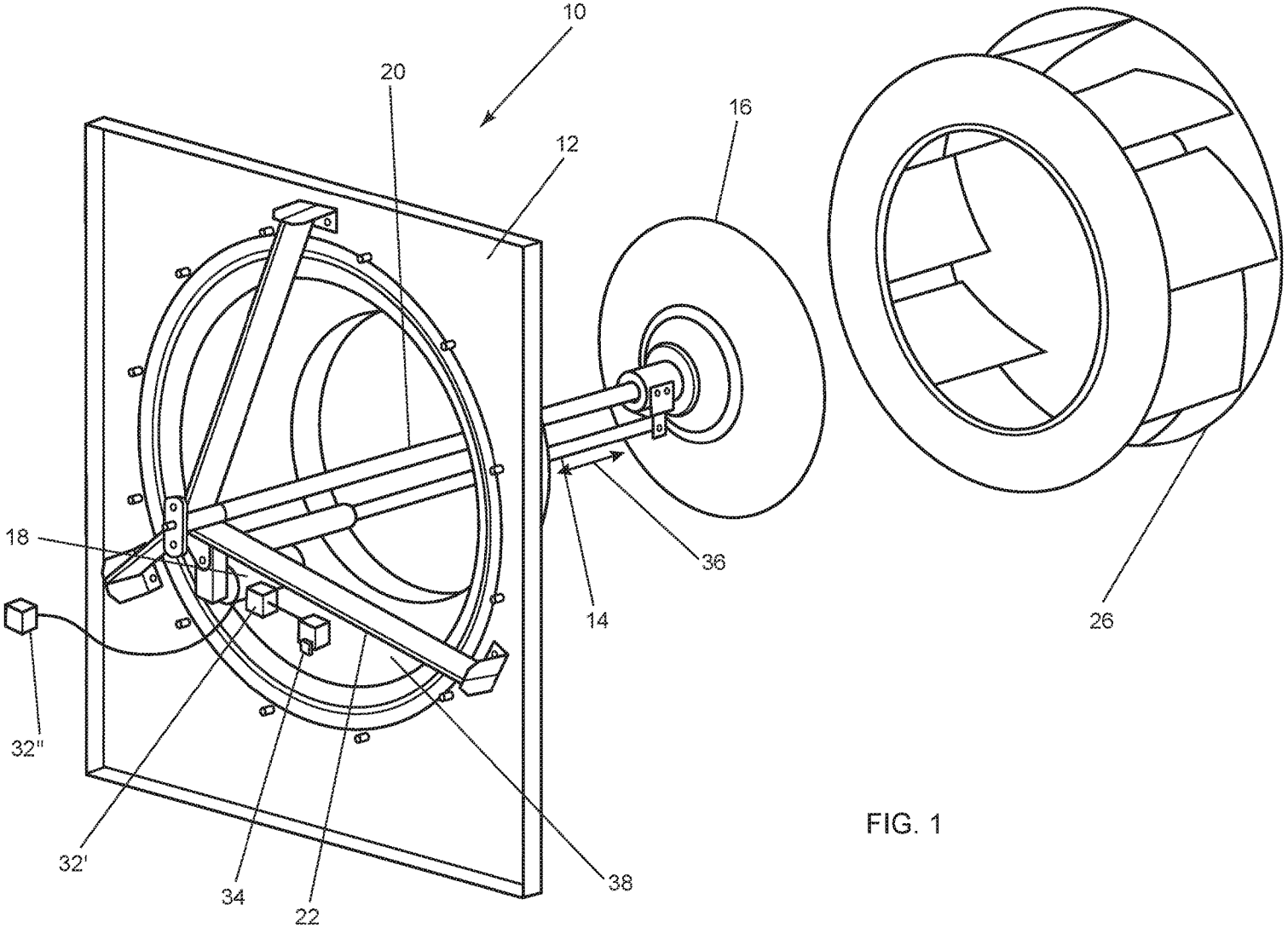
FIG. 1 is an exploded view of the preferred fan assembly with the valve in an open position.
Figure 2:
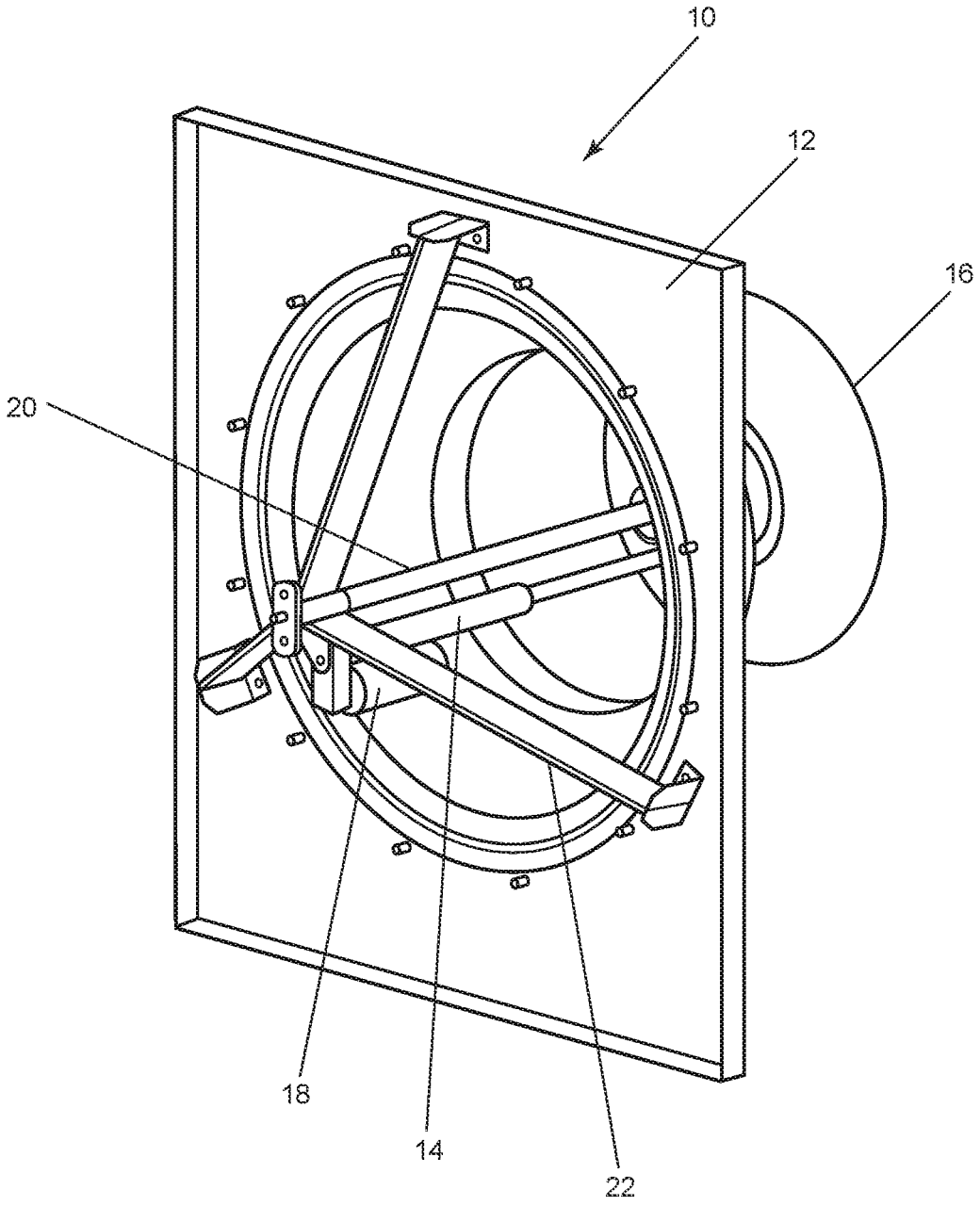
FIG. 2 is a front perspective view of the preferred fan inlet assembly of FIG. 1, without the fan wheel.
Figure 3:
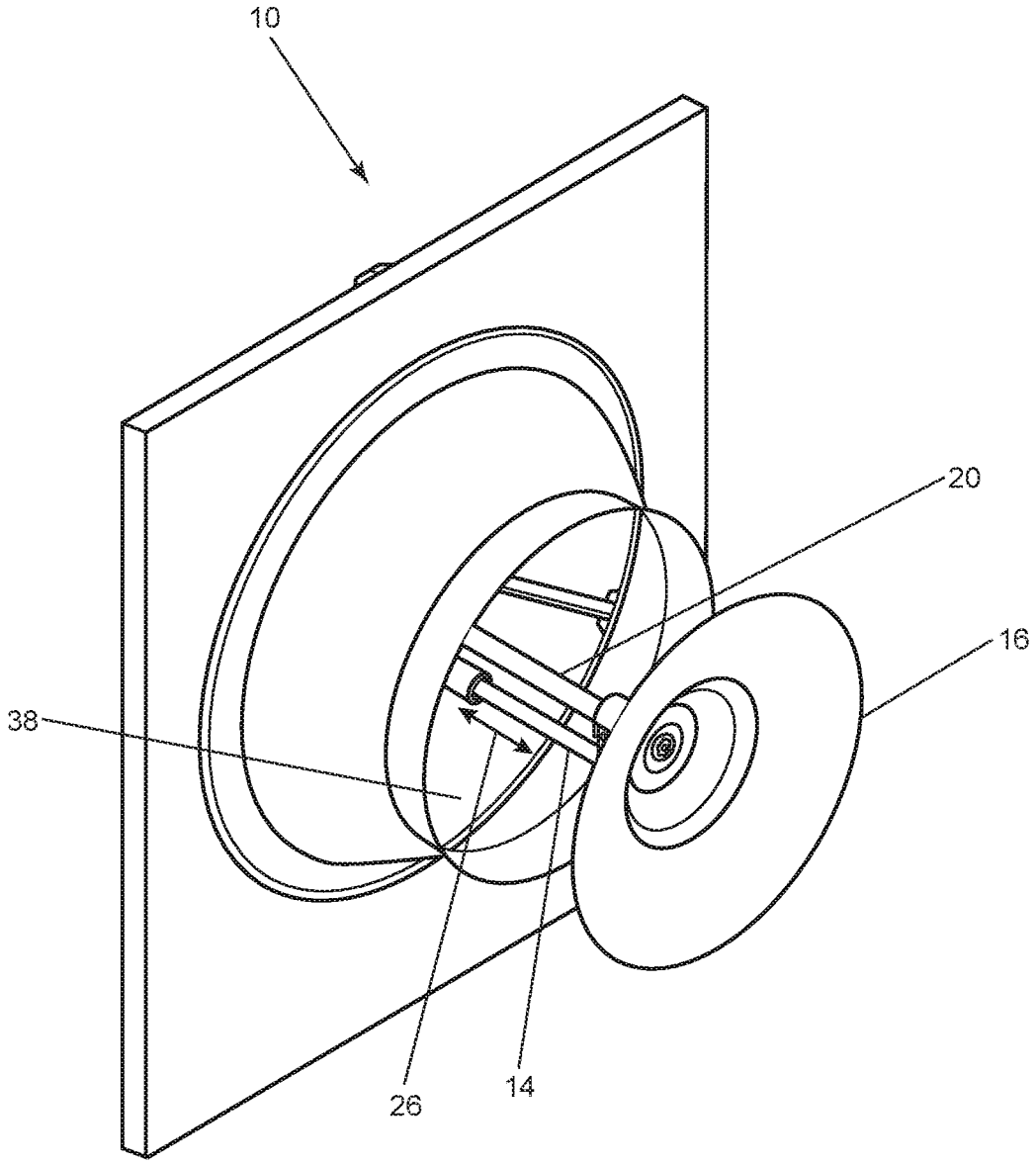
FIG. 3 is a side view of the preferred fan inlet assembly of FIG. 1.
Figure 4:
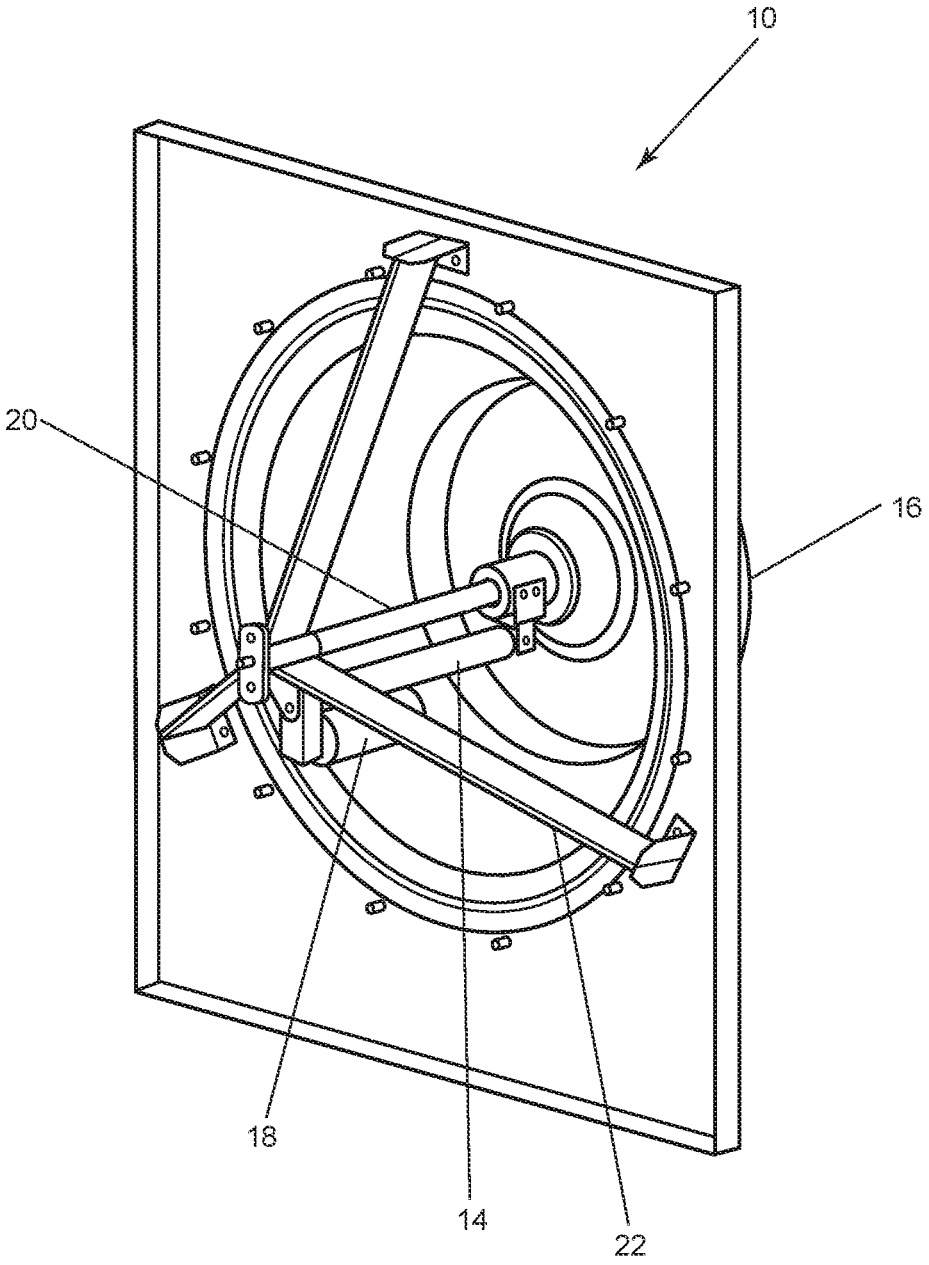
FIG. 4 is a front perspective view of the preferred fan inlet assembly, with the valve in a closed position.
Figure 5:
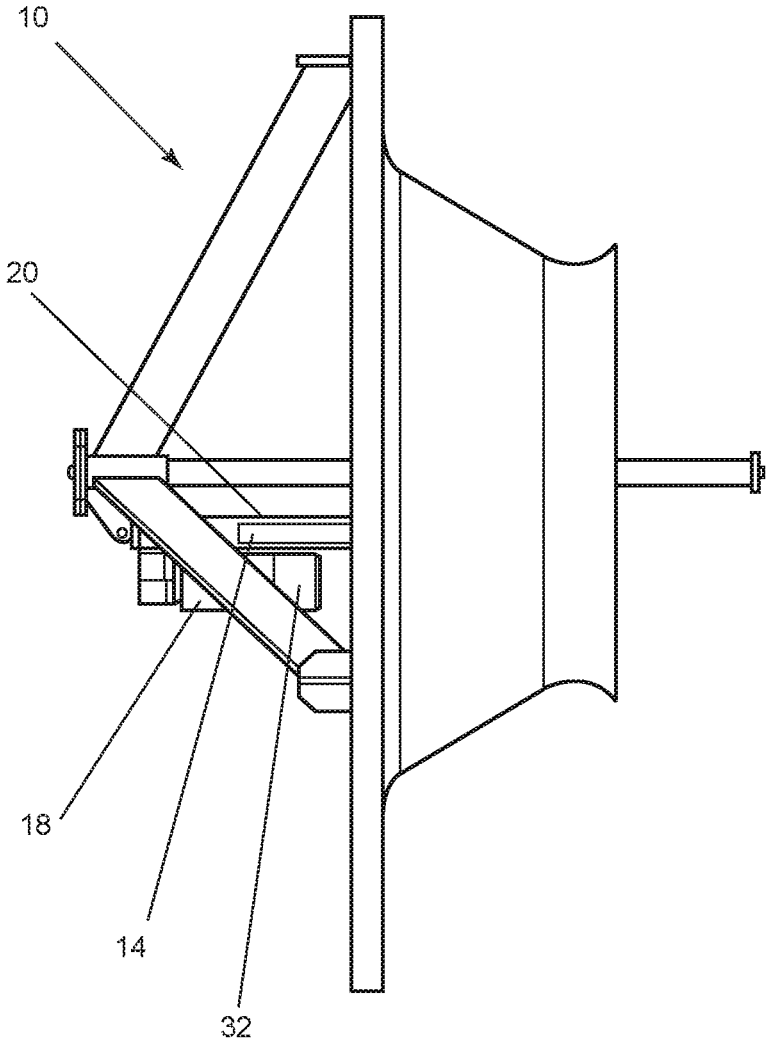
FIG. 5 is a side view of the preferred fan inlet assembly of FIG. 4.

DESCRIPTION OF THE PREFERRED EMBODIMENTS (BEST MODES FOR CARRYING OUT THE INVENTION)

The claimed invention comprises a device for adjusting the width of the wheel of a centrifugal fan and a control system to determine when to adjust the width of the wheel. The control system may or may not be a module within a larger control system.

A single fan assembly 10 is shown in FIGS. 1-5. A fan system consists of a single fan, or two or more fans operating in parallel. A single fan assembly 10 comprises inlet cone wall 12, linear operator 14, conical valve 16, motor 18, linear guide 20, and braces 22 for holding linear operator 14 and linear guide 20 in place on inlet cone wall 12. Linear operator 14 and motor 18 can be a single unit. The apparatus for tuning the effective width of the fan wheel 26 comprises conical valve 16 that is allowed to move forward and backward 36 propelled by linear operator 14 within the fan wheel 26 on a linear guide 20. Linear operator 14 preferably is a telescoping apparatus well known in the art. Cone shaped valve 16 is designed to be larger than the opening of the fan inlet 38, and may be driven completely closed to prevent flow through the fan. Conical valve 16 is moved 36 by a linear operator 14 under direction of a control system 32. The presently claimed invention is used on a variable speed fan when air volume delivery is being controlled by adjusting the speed of the fan. Conical valve 16 is used to tune the effective width of the wheel to allow for efficient operation of the fan over a wide range of operating conditions.

Control system or controller 32' and alternative controller 32" preferably comprises of a microprocessor based controller that monitors the flow rate of each fan in a fan system, and the total calculated static pressure of which the fan is operating. Controller 32' can be disposed on the fan system or located remotely 32". Controller 32" can also be part of the fan speed controller. Monitoring the flow rate can accomplished by several methods. Preferably, a measurement of the pressure differential between a sensor 34 disposed on the narrowest part of the inlet cone 38 and another a measurement of second sensor upstream of the fan, with the measurement converted into a flow rate.

There are other ways to measure fan flow as well. Alternative methods for obtaining the flow rate are to mount a device at the inlet of the fan cone that provides a CFM measurement using two thermistors and air temp and power loss, calculating fan flow from fan revolutions per minute (RPM), fan power, and by using any number of methods for duct flow measuring that are well known in the art. Based on the performance data the fan controller 32 is able to determine if fan 26 is too close to stall, and automatically adjusts the position of valve 16.

Based on the current flow rate measurement the controller calculates the current static pressure the fan will stall at using formula 1:

$$SP_s = SP_b * \left(\frac{Q_c}{Q_b}\right)^2$$

Where:

$SP_s$ is the current stall pressure $SP_b$ is the fans specified stall pressure $Q_b$ is the volume flow at the specified pressure $Q_c$ is the currently measured fan volume.

Figure 11:
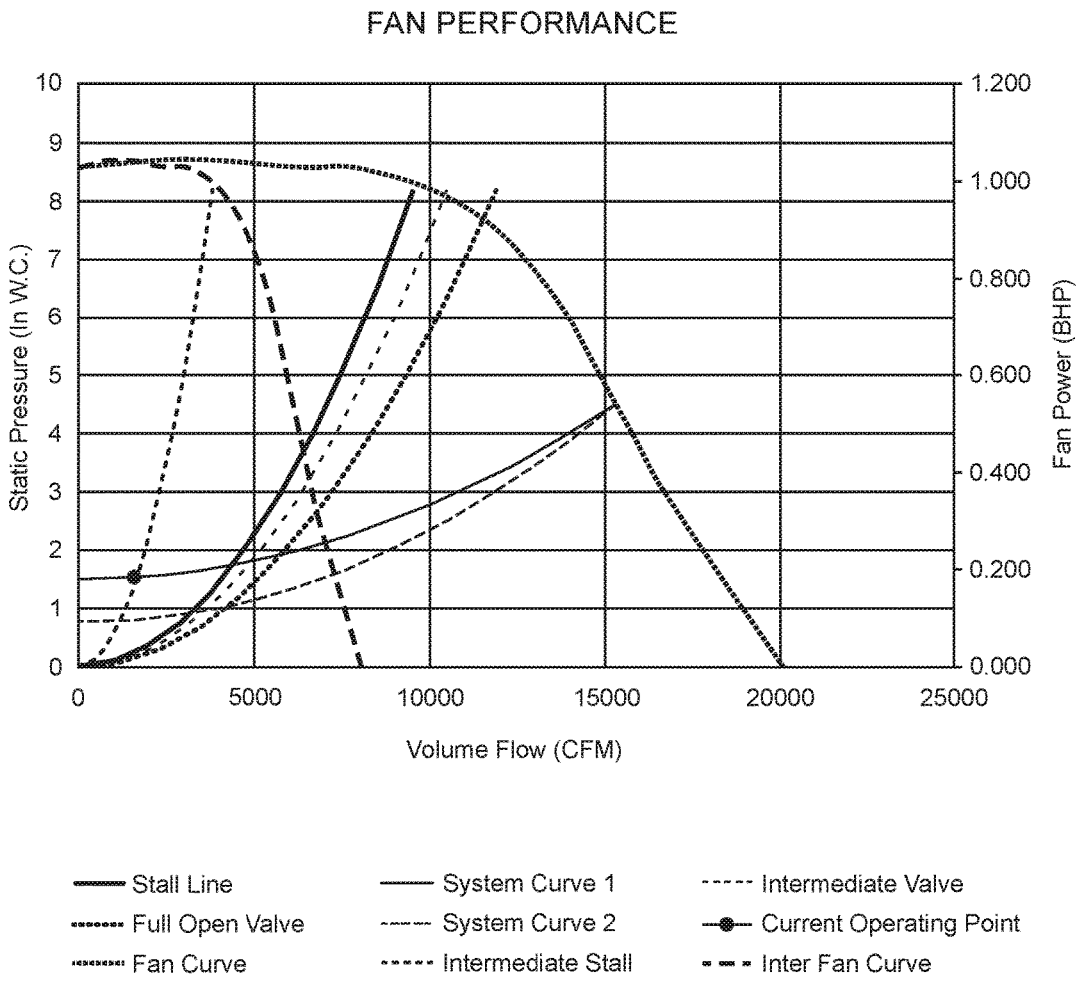
FIG. 11 is a graph plotting the fan stall at differing static pressures, fan powers, and volume flows.

Graph 1 seen in FIG. 11 clearly shows fan stall at differing static pressures, fan powers, and volume flows. This graph can be used as an electronic lookup table in a microprocessor, or the like, for adjusting valve 16 for optimal performance. Manual entry of valve adjustments can also be made.

Figure 6:
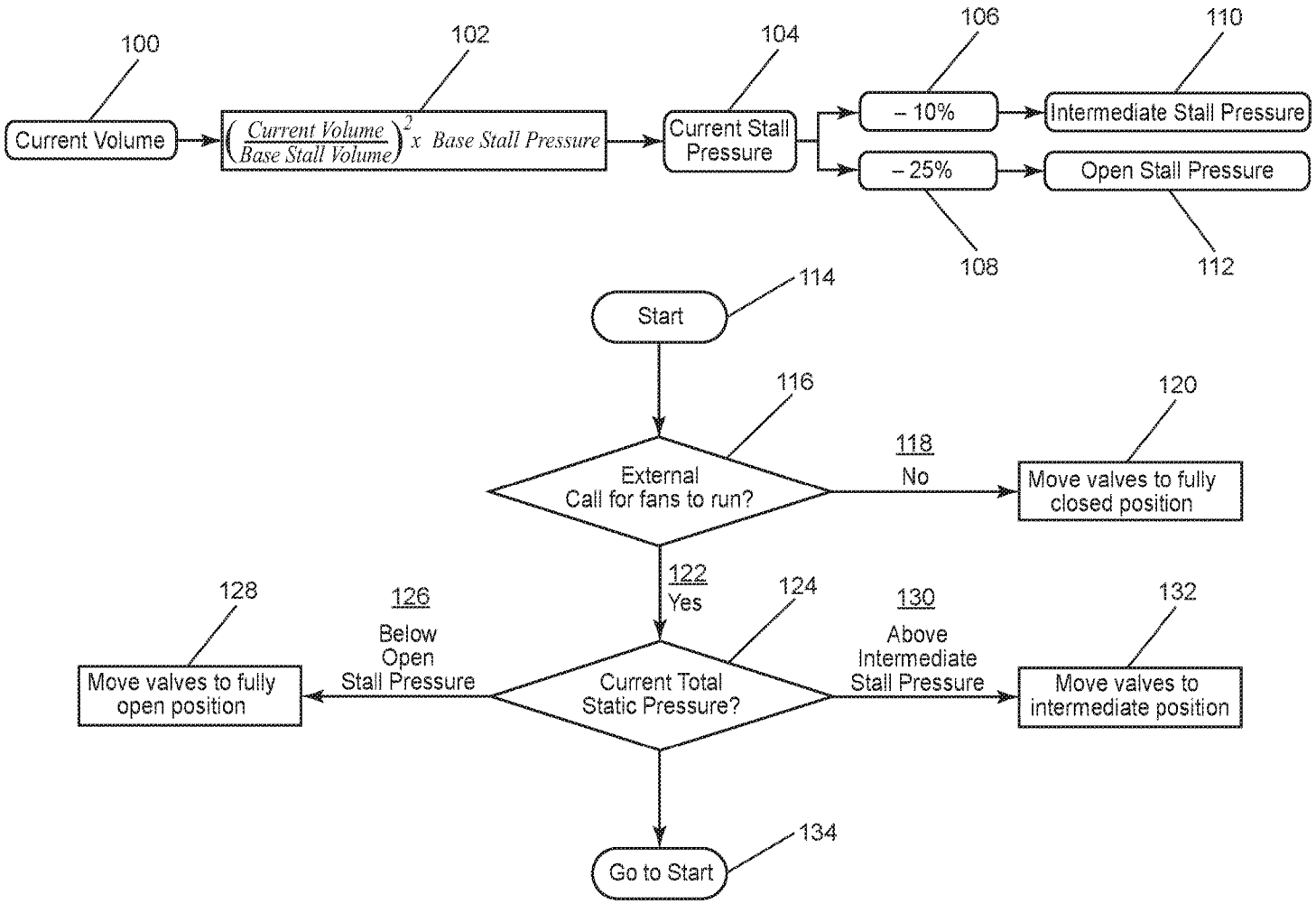
FIG. 6 is a flow chart showing the preferred method and computer program for the main control loop.

FIG. 6 is a flow chart showing main control loop for fan system 10. Current volume 100 is obtained from the means for measuring, and using formula 102 current stall pressure 104 is calculated by using a first predetermined stall pressure offset 106 and a second predetermined stall pressure offset 108, which offsets correspond to an intermediate stall pressure 110 and open stall pressure 112. Using these parameters, the initial start 114 is actuated, which calls for fans to run 116. If fans are not called to run 118, controller 32 prompts valve(s) to a fully closed position 120. In this disclosure the terms "called to run" means there is an external signal or prompt that indicates that the fans should be running, using a timeclock, a remote signal, or the like. If fans are called to run 122, current total static pressure is measured 124. If the current measured total static pressure is below open stall pressure, per step 126, controller moves valve(s) to fully open position 128. If the current measured current static pressure is above intermediate stall pressure, per step 130, controller moves valve(s) to intermediate position 132. The system is then initiated 134.

Figure 7:
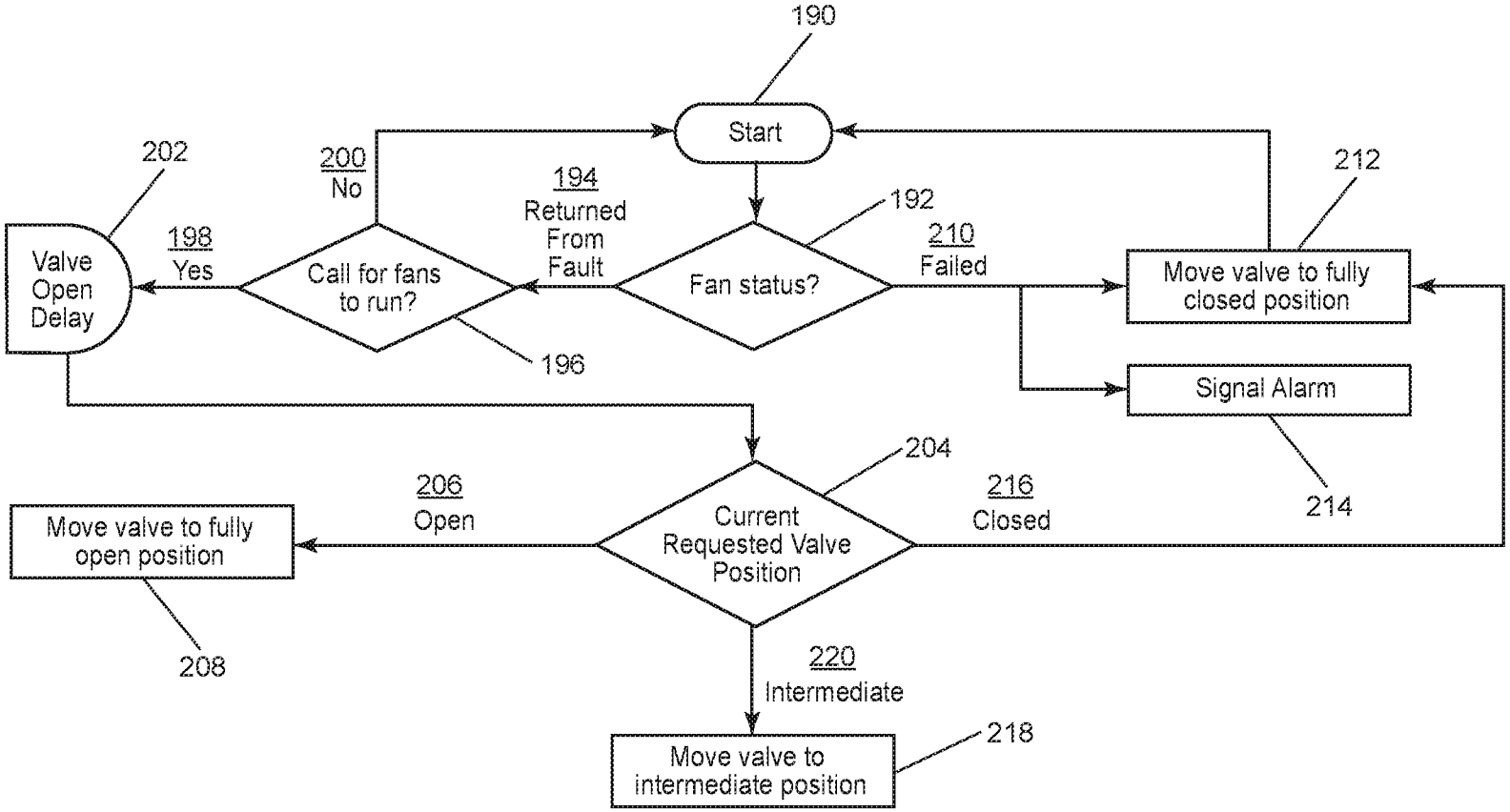
FIG. 7 is a flow chart that identifies the steps for a fan failure and restart.

FIG. 7 is a flow chart showing the steps for fan failure and restart. At start 190 the fan status 192 is determined. If the status is returned from fault 194, the controller 32 checks if there is a call for the fans to run 196. If the call is negative 200, the system returns to start 190. If the call is positive 198, the valve open delay 202 is initiated and the current requested valve position 204 is determined. If it is open 206, a prompt to move the valve to fully open position is made 208. If the fan status 192 is deemed to have failed 210, a prompt to move the valve to fully closed position 212 is made, and simultaneously a signal alarm 214 is activated. If the current requested valve position 204 is closed 216, a prompt to move the valve to fully closed position 212 is made. If the current requested valve position 204 is intermediate 220, a prompt to move the valve to the intermediate position 218 is made.

Figure 8:
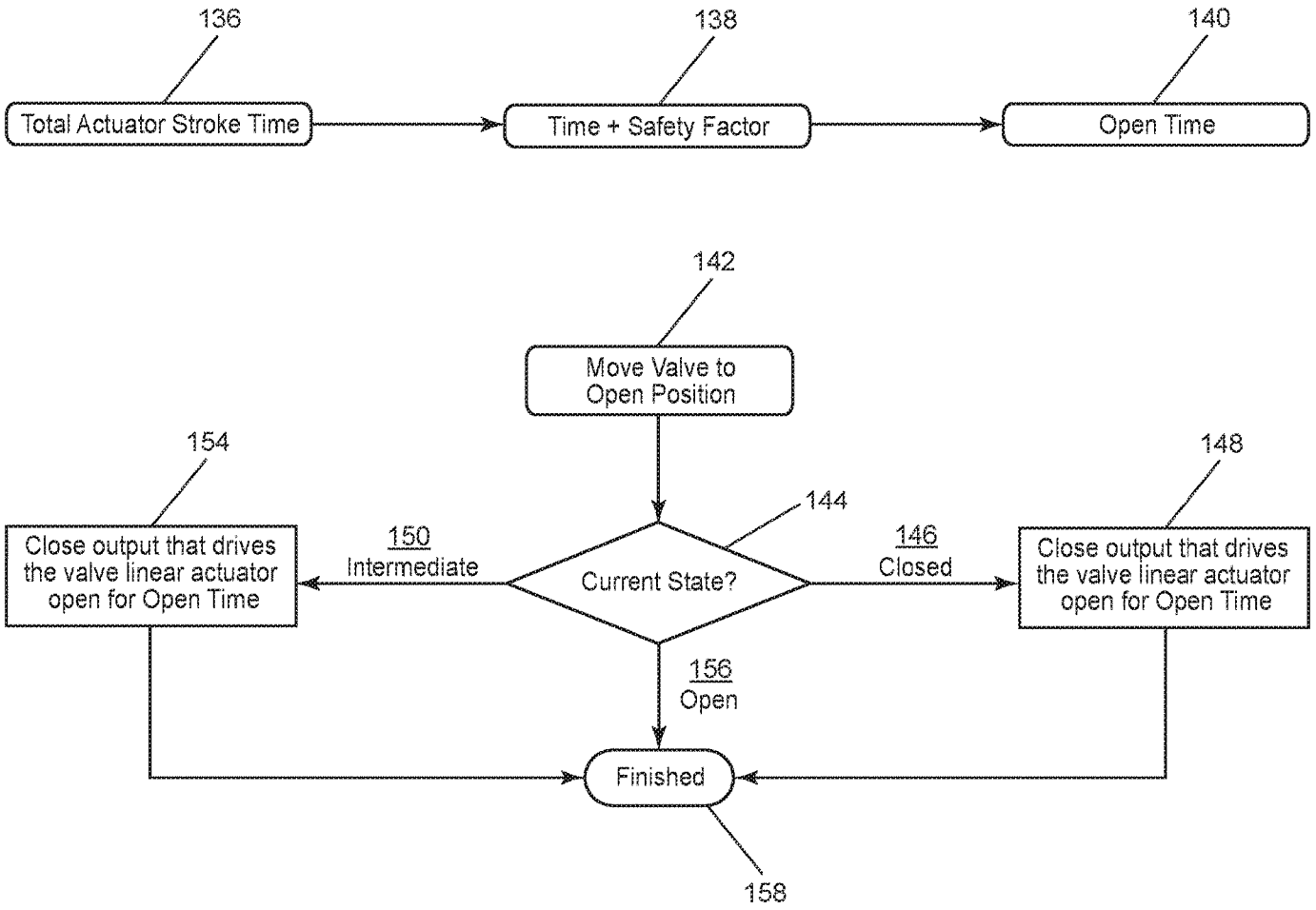
FIG. 8 is a flow chart identifying the step for moving the valve to an intermediate position.

FIG. 8 is a flow chart that shows the preferred method for opening valve(s) 16 to full open position. Timing for positioning the valve(s) is significant. Total actuator stroke time 136 is combined with a safety factor 138 to come up with an open time 140. Controller 32 prompts valve(s) to move to open position 142, and determines current state 144. If the current state of valve(s) is closed 146, controller closes output that drives the linear actuator open for open time 148 as defined above. If the current state is in an intermediate position 150, controller closes output that drives linear valve actuator open for open time 154 as defined above. If valve(s) are in an open position 156, each of the options is open and the method is finished 158.

Figure 9:
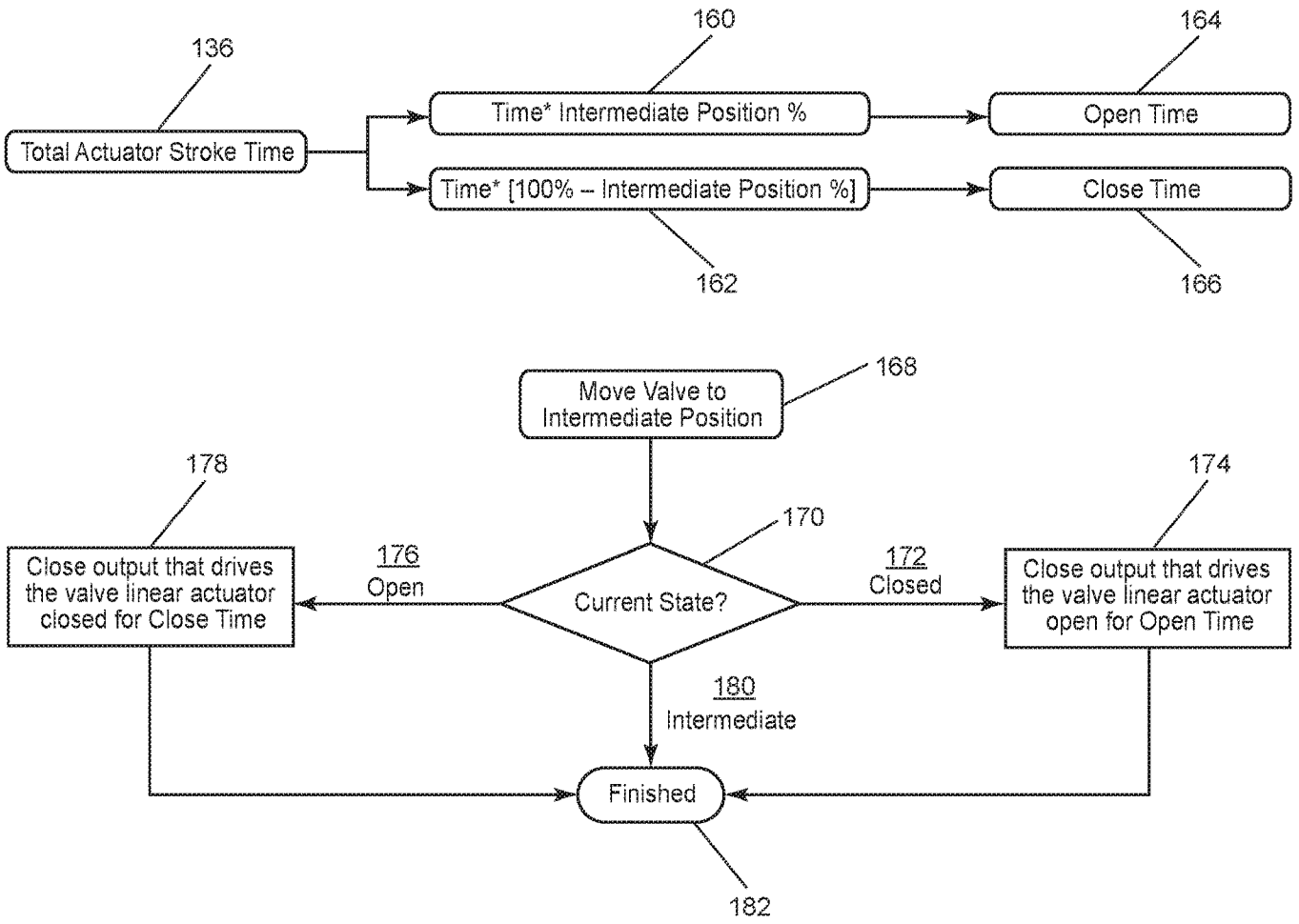
FIG. 9 is a flow chart showing the steps to move the valve to a fully open position.

FIG. 9 shows the preferred method for opening valve(s) to an intermediate position. Again, time is a factor in this method. Total actuator stroke time 136 is multiplied with a predetermined percentage of actuator time 160, and results in an open time 164. Total actuator time 136, multiplied by the result of 100% minus the intermediate position percentage 163, results with a close time 166. To begin the process, controller prompts valve(s) 16 to move to an intermediate position 168. Current state of valve(s) is determined 170. If valve(s) is in a closed position 172, controller closes output that drives valve linear actuator open for open time 174 as defied above. If the current state of valve is in the open position 176, controller closes the output that drives linear actuator to close valve(s) for close time 178 as defined above. If the current state of valves(s) is intermediate 180, each of the options is intermediate and the method is finished 182.

Figure 10:
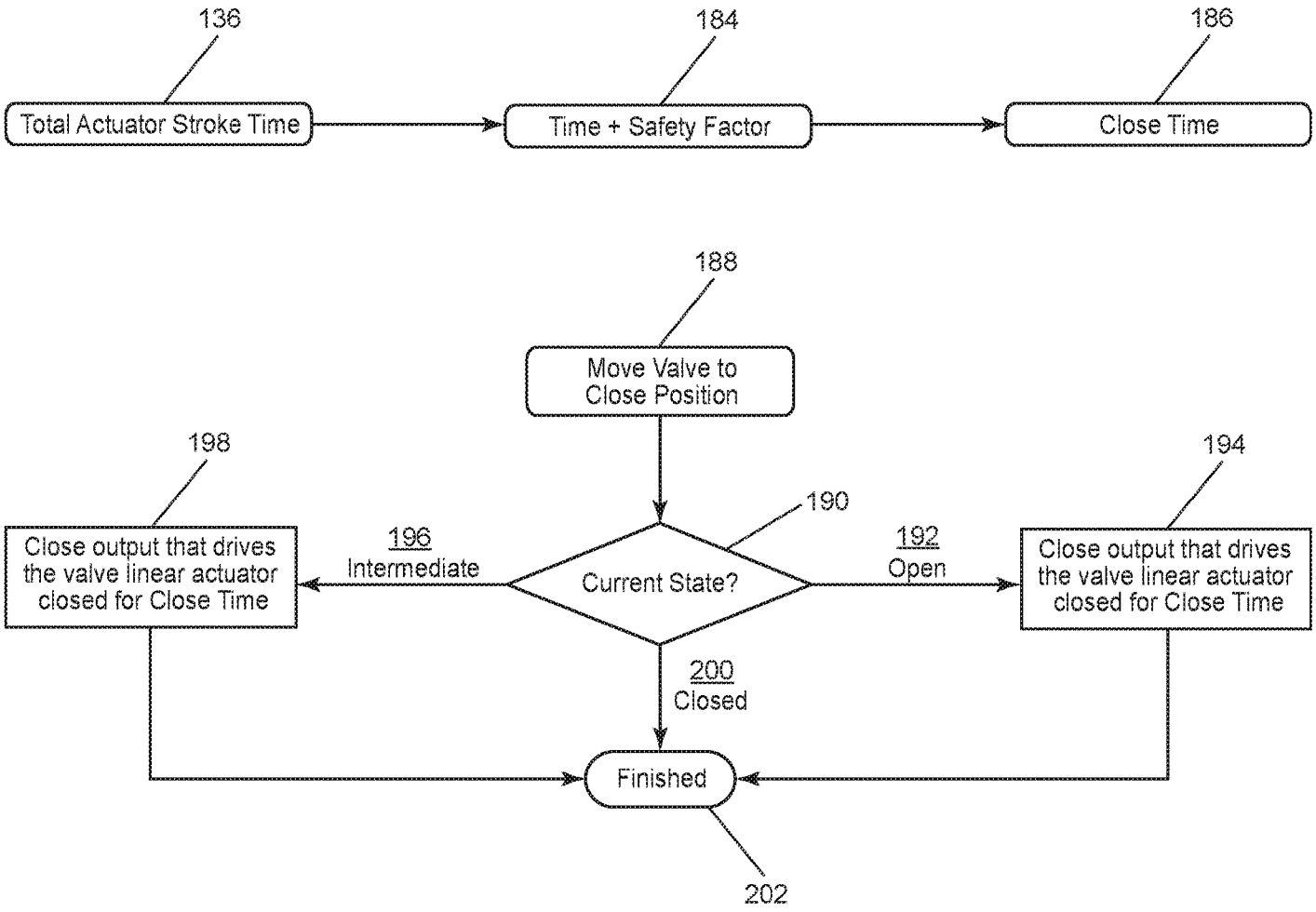
FIG. 10 is a flow chart showing the steps to move the valve to a fully closed position.

Reference is made to FIG. 10, showing the preferred method to move the valve to a closed position. As in the previous scenarios, time is a factor. Total actuator stroke time 136 is summed with a safety factor 184 to calculate a close time 186. The safety factor may be the same or different than in previous methods. Controller 32 prompts valve(s) to move to a close position 188 and determines current state 190. If the current state of valve(s) is open 192, controller 32 closes output that drives the linear actuator closed for close time 194 as defined above. If the current state is in an intermediate position 196, controller 32 closes output that drives linear valve actuator closed for close time 198, as defined above. If valve(s) are in a closed position 200, each of the options is closed and the method is finished 202.

Controller 32 uses current stall pressure 104, along with a predefined and adjustable open percentage offset 106 and intermediate percentage offset 108 from the current stall pressure 104, to determine in what position valve 16 should be. If the measured total static pressure is above the current stall pressure 104 minus the intermediate percentage 108, controller 32 will move valve 16 to the predefined and adjustable intermediate position. Once the measured total static pressure falls below the current stall pressure 104 minus the open percentage 106, controller 32 shall fully open valve 16. Although the above method describes three valve positions, this disclosure is not limited to this number but intended to include any number of valve positions.

The valve movement 36 can either be a closed loop system for precise control of the valve position, or in open loop to provide a lower cost system provided valve 16 remains in position when not commanded to move.

It is possible to operate the system in a continuous mode where controller 32 calculates the current stall pressure based on both the measured flow and the current valve position, and adjusts valve 16 continuously to maintain fan 26 at peak efficiency across a large range of operating conditions.

An additional, optional, function of the claimed invention is to stop reverse flow through fan 26 when it has failed, and to allow that fan to restart even if other fans in the array are running. When a fan failure is detected by control system 32, control system 32 fully closes the valve 16 on the failed fan. Control system 32 leaves the valve 16 closed until the fault is cleared. Once cleared, if there is a call for fan 26 to run, control system 32 starts the fan 26 and holds the valve 16 closed for a predetermined user defined time to allow fan 26 to pre-spin-up in the correct direction. After the predetermined time, the valve 16 is moved to the location determined by the flow and static pressure (Graph 1), as described above.

Typically, the claimed invention is installed on a fan system within HVAC air handlers (AHU) and are attached to a variable air volume (VAV) air delivery system to various zones within a building. In these systems as the zones call for heating or cooling the zone controls will open a damper. As this damper opens the pressure in the supply duct to all zones will drop. As the pressure drops, the fan within the AHU will increase in speed to match the request for additional airflow.

When there are only a few zones calling for cooling or heating the AHU needs to be able to supply a small volume of air at a sufficient pressure. Since there is a minimum pressure required at each zone, the total static pressure across the fans is not proportional to required flow, and the total static pressure across the fan system is higher than would be predicted by a square of the change in flow curve. This normally results in the fan system operating in the stall area. The invention allows adjusting the fan wheel width, which increases the pressure for a given flow at which the fan will stall (as shown in Graph 1 of FIG. 11), allowing a higher overall reduction in airflow while maintaining high fan efficiency without operating in the stall region than would be available through speed control alone.

Industrial Example

Below is an example of a system using the claimed system, method, and computer program to adjust the width of a conical fan wheel to optimize the operation of a fan.

Sequence of Operation

Start/Stop

The unit shall have the following options to start/stop the unit.

Hardwires

BMS

Local Time Clock

Keypad (keypad stop command overrides the Hardwire, BMS and time clock commands)

Normal Start

The unit is called to run there will be a 30 (adj.) second delay time before the flow valves 16 are opened and then the supply fans 26 started.

Normal Stop

The supply fans 26 are stopped. Minimum on timers is respected. All flow valves 16 are driven to the fully closed position after a 30 (adj.) second delay after fans 26 are stopped.

Emergency Stop

The emergency stop input is intended for use by life safety systems to stop fans 26 rapidly. This shall bypass all minimum on timers and other safeties that would prevent supply fans 26 from being stopped. All flow valves 16 shall be driven to the fully closed position.

Supply Fan

Safeties

The high static safety and door interlocks are wired to the VFD emergency input. If either of these faults is active, fans 26 will immediately shut down and controller 32 will indicate a VFD Fault.

Supply Fan (BMS)

Supply fan speed to be controlled by the BMS. The BMS control signal shall be overridden at the keypad to allow time for the unit to normalize temperatures. Supply fan 26 shall remain on for 30 seconds (adj.) after a unit stop command. If the unit is equipped with supply air isolation dampers, the dampers shall remain open until supply fan 26 stops.

Supply Fan (Supply Duct Static Pressure)

Supply Fan Pressure Selection

The duct static pressure input shall be used to control the supply fan speed. If the measured duct static pressure falls below 0.2" w.c. (adj.) controller 32 shall switch the pressure input to the discharge plenum static pressure input. It shall continue to use the discharge plenum static pressure input until the measured supply duct static pressure rises above 0.75" w.c. (adj.). Supply fan speed is controlled to maintain supply duct static pressure. A PI loop shall be used to control the speed of supply fan 26 to a supply duct static pressure set point of 1.5-inch w.c. (adj.). This PI loop shall be capable of override at the keypad to allow time for the unit to normalize temperatures. Supply fan 26 shall remain on for 30 seconds (adj.) after a unit stop command. If the unit is equipped with supply air isolation dampers the dampers must remain open until supply fan 26 stops.

Supply Fan (Supply CFM)

Supply fan speed is controlled to supply CFM as measured by airflow station. A PI loop shall be used to control the speed of supply fan 26 to a supply CFM set point (adj.). This PI loop shall be capable of override at the keypad to allow time for the unit to normalize temperatures. Supply fan 26 shall remain on for 30 seconds (adj.) after a unit stop command. If the unit is equipped with supply air isolation dampers the dampers shall remain open until the supply fan stops.

Supply Fan Flow (Flowtrac—one Device to Each Fan)

Each fan 26 in the array of fans shall have a Flowtrac fan flow sensor. The pressure reading from this device shall be converted to a flow via the following formula:

$$CFM = F_c * \sqrt{\Delta Pressure}$$

The $F_c$ (flow coefficient) factor shall be adjustable. All fans shall use a common $F_c$ factor. The CFM from each sensor shall be summed to present a total flow.

Supply Fan Flow Valve

Each fan is equipped with a flow valve 16. This valve 16 allows the effective width of the wheel to be adjusted. The controller shall monitor the CFM and TSP across fan 26, and adjust flow valve 16 on all the fans in the array to the same position and fan speed to prevent fans 16 from stalling at low flows. If a fan fails, the flow valve for that fan shall be driven closed to prevent recirculation of air.

Variables

FanLine: "ELPF", "Optiline", "Optiflow"

The ELPF, Optiline, and Optiflow numbers in this example are the designations for different fan sizes that applicant Energy Labs, Inc., makes in each fan line. This is used to look up the correct flow coefficient to use in the pressure to flow calculation. Instead of having an editable field for the flow coefficient it is far easier for the users to specify the type and size of fan.

Fan Size:

ELPF: 135, 150, 165, 182, 200, 222, 245, 270, 300, 330, 365, 402, 445, 490, 542, 600

Optiline: 165, 182, 200, 222, 245, 270, 300, 330, 365

Optiflow: 165, 182, 200, 222, 245, 270, 300, 330, 365

StallPressure: Lookup based on fan selection

StallCFM: Lookup based on fan selection

StallSafetyIntermediate: 10%, Technician adjustable, 0-100%.

StallSafetyFull: 25%, Technician adjustable, 0-100%, must be greater than, or equal to StallSafetyIntermediate.

IntermediatePosition: 40%, Technician adjustable 0-100%

FlowControlDelay: 120 Seconds, Factory adjustable 0-600 seconds

CFMAverage: The flow from all active fans shall summed and divided by the quantity of active fans.

StallPressureIntermediate:

StallPressureIntermediate:

$$StallPressure * \frac{CFMAverage}{(StallCFM * StallSafetyIntermediate) + StallCFM}$$

StallPressureFull:

$$StallPressure * \frac{CFMAverage}{(StallCFM * StallSafetyFull) + StallCFM}$$

Valve Control

The actuator has an open stroke time of 60 seconds (adj.). The actuator has a closed stroke time of 60 seconds (adj.). An opened and closed output moves the valve while the output is held on in the desired direction. The stroke time shall be used to determine how long to hold the opened or closed output on to get to the desired opening position. The actuator has internal end switches for the fully closed and fully opened positions, so a small amount of overdriving should be used to ensure that the valve is correctly positioned when driven to the fully open or fully closed positions.

Valve Position

When the fans are called to start, all valves shall be driven to the fully opened position and the fan start shall be delayed for zero (0) seconds (adj.). The valve shall be held in the fully open position for the first 120 seconds (adj.) of fan run time. If the measured total static pressure (TSP) rises above StallPressureIntermediate for the current average flow (CFMAverage), all flow valves on active fans shall be driven to the intermediate position. Once the measured TSP falls below StallPressureFull for the current average CFM (CFMAverage), all flow valves on active fans shall be driven to the fully opened position.

Failed Fan Valve Control and Fan Restart

If a fan fails, the flow valve to that fan shall be driven to the fully closed position and held closed until the fault is clears. When the fault clears, the valve shall be held closed for 30 seconds (adj.) to allow the fan to spin up prior to opening the flow valve. After the delay the flow valve shall be driven to the same position as all the other valves.

Dual Power Supplies

The unit is equipped with dual power supplies. The controller, all flow valve actuators, and some of the fans are connected to power supply #1 (PS1). The remaining fans are connected to power supply #2 (PS2). If the status input of a power supply indicates an issue with the power, the fans on that power supply shall be stopped. Once power is signaled good again for 120 seconds (adj.) the fans on that power supply shall be restarted.

Network Points

At a minimum the following points shall be available via network communications:

Start/Stop input from BMS

Supply duct static pressure setpoint input

CFM output for each fan

Status for each fan

1=Off, 2=ON—Intermediate, 3=On—Fully open, 4=Off—Alarm

Total Array CFM

VFD failure alarm for each VFD

Power Supply 1 Failure Alarm

Power Supply 2 Failure Alarm

High Duct Static Pressure Alarm

External Shutdown Alarm

Fan speed (0-100% speed)

While various embodiments of the disclosed method and apparatus have been described above, it is understood that they have been presented by way of example only, and should not limit the claimed invention. Likewise, the various diagrams may depict an example, architectural or other configuration, for the disclosed method and apparatus. This is done to aid in understanding the features and functionality that can be included in the disclosed method and apparatus. The claimed invention is not restricted to the illustrated example, architectures or configurations, rather the desired features can be implemented using a variety of alternative architectures and configurations. Indeed, it will be apparent to one of skill in the art how alternative functional, logical, or physical partitioning, and configurations can be implemented to realize the desired features of the disclosed method and apparatus. In addition, a multitude of different constituent module names other than those depicted herein can be applied to the various partitions. Additionally, regarding flow diagrams, operational descriptions, and method claims, the order in which the steps are presented herein shall not mandate that various embodiments be implemented to perform the recited functionality in the same order unless the context dictates otherwise.

Although the disclosed method and apparatus is described above in terms of various exemplary embodiments and implementations, it is understood that the various features, aspects, and functionality described in one or more of the individual embodiments are not limited in their applicability to the particular embodiment with which they are described. Thus, the breadth and scope of the claimed invention should not be limited by any of the above-described exemplary embodiments.

Terms and phrases used in this document, and variations thereof, unless otherwise expressly stated, should be construed as open ended, as opposed to limiting. As examples of the foregoing: the term "including" should be read as meaning "including, without limitation" or the like; the term "example" is used to provide exemplary instances of the item in discussion, not an exhaustive or limiting list thereof; the terms "a" or "an" should be read as meaning "at least one," "one or more" or the like; and adjectives such as "conventional," "traditional," "normal," "standard," "known," and terms of similar meaning should not be construed as limiting the item described to a given time period or to an item available as of a given time, but instead should be read to encompass conventional, traditional, normal, or standard technologies that may be available or known now or at any time in the future. Likewise, where this document refers to technologies that would be apparent or known to one of ordinary skill in the art, such technologies encompass those apparent or known to the skilled artisan now or at any time in the future.

A group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements, or components of the disclosed method and apparatus may be described or claimed in the singular, the plural is contemplated to be within the scope thereof unless limitation to the singular is explicitly stated.

The presence of broadening words and phrases such as "one or more," "at least," "but not limited to" or other like phrases, in some instances shall not be read to mean that the narrower case is intended or required in instances where such broadening phrases may be absent. The use of the term "module" does not imply that the components or functionality described or claimed as part of the module are all configured in a common package. Indeed, any or all the various components of a module, whether control logic or other components, can be combined in a single package or separately maintained and can further be distributed in multiple groupings or packages or across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives can be implemented without confinement to the illustrated examples. For example, "block diagrams" and their accompanying description should not be construed as mandating a particular architecture or configuration.

In one or more exemplary embodiments, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures, and that can be accessed by a computer. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and BLU-RAY disc where disks usually reproduce data magnetically, while discs reproduce data optically with lasers. Combinations of the above should also be included within the scope of computer-readable media.

Although the embodiments of the claimed invention have been described in detail with particular reference to these preferred embodiments, other embodiments can achieve the same results. It is anticipated that the software that utilizes the method will continue to change the appearance of its user interface and evolve. Variations and modifications of the presently claimed invention will be obvious to those skilled in the art, and it is intended to cover in the appended claims all such modifications and equivalents. The entire disclosures of all references, applications, patents, and publications cited above, are hereby incorporated by reference.

What is claimed is:

1. A fan system comprising:

at least one variable speed fan comprising an adjustable valve for controlling a volume of air for delivery and for varying an effective width of a fan wheel;

a means for monitoring a flow rate of the volume of air;

a sensor configured to measure a static pressure differential across the fan;

a microprocessor configured to calculate a stall static pressure based on the volume of air from the means for monitoring; and a first controller configured to adjust the adjustable valve based on the measured static pressure differential and the calculated stall static pressure.

2. The fan system of claim 1 wherein the means for monitoring comprises at least one sensor.

3. The fan system of claim 1 wherein the means for monitoring a flow rate comprises a calculated flow rate.

4. The fan system of claim 1 wherein the microprocessor configured to calculate a stall static pressure comprises using the formula $$SP_s = SP_b * \left(\frac{Q_c}{Q_b}\right)^2.$$

5. The fan system of claim 1 wherein the first controller is configured to vary a speed of the fan.

6. The fan system of claim 1 further comprising a second controller configured to vary a speed of the fan.

7. The fan system of claim 1 wherein the adjustable valve comprises a linear operator.

8. The fan system of claim 1 wherein the at least one variable speed fan comprises a centrifugal fan.

9. The fan system of claim 1 wherein the adjustable valve further comprises a fan fault closing valve.

10. A method for adjusting characteristics of a centrifugal fan, the method comprising the steps of:

varying flow characteristics of the fan with an adjustable valve;

monitoring a flow rate of the volume of air;

measuring a static pressure differential across the fan calculating a stall static pressure from the monitored flow rate; and adjusting the adjustable valve based on the measured static pressure differential and the calculated stall static pressure.

11. The method of claim 7 wherein the step of monitoring comprises using a sensor.

12. The method of claim 7 wherein the step of monitoring comprises calculating a flow rate.

13. The method of claim 7 wherein the step of calculating a stall static pressure comprises using the formula $$SP_s = SP_b * \left(\frac{Q_c}{Q_b}\right)^2.$$

14. The method of claim 7 further comprising the step of varying a speed of the fan.

15. The method of claim 7 wherein the step of varying the volume of air comprises moving a conical valve linearly.

16. The method of claim 7 further comprising the steps of:

detecting a fan fault condition; and closing the adjustable valve until the fault condition has ceased.

17. A non-transitory computer-executable storage medium comprising program instructions which are computer-executable to implement a variable volume of air to prevent a stall condition in a fan assembly comprising:

program instructions configured to cause a measurement of a flow rate of a volume of air;

program instructions configured to cause a static pressure differential measurement across the fan;

program instructions configured to cause a calculation of stall static pressure of the volume of air from the measured flow rate; and program instructions configured to cause a controller to vary the flow characteristics of the fan by adjusting a valve based on the program instructions configured to cause a static pressure differential measurement and the program instructions configured to cause a measurement of a flow rate.

18. The non-transitory computer-executable storage medium of claim 17 wherein the program instructions configured to cause a measurement of the flowrate comprise a sensor.

19. The non-transitory computer-executable storage medium of claim 17 wherein the program instructions configured to cause a measurement of the flowrate further comprise program instructions configured to cause a calculated flow rate.

20. The non-transitory computer-executable storage medium of claim 17 wherein the program instructions configured to cause a calculation of a stall static pressure differential comprises using the formula $$SP_s = SP_b * \left(\frac{Q_c}{Q_b}\right)^2.$$

21. The non-transitory computer-executable storage medium of claim 17 further comprises program instructions configured to cause a variation of a speed of the fan.

22. The non-transitory computer-executable storage medium of claim 17 further comprises:

program instructions configured to cause a fan fault condition be detected; and program instructions configured to cause the adjustable valve to remain closed until the fault condition has ceased.

* * * * *